US007461956B2

(12) United States Patent
Swanson

(10) Patent No.: US 7,461,956 B2
(45) Date of Patent: Dec. 9, 2008

(54) LAMP HAVING ONE OR MORE LOW LIGHT LEVEL REPLACEABLE BULBS

(75) Inventor: Dennis K. Swanson, Woodland Hills, CA (US)

(73) Assignee: Lamps Plus, Inc., Chatsworth, CA (US)

( * ) Notice: Subject to any disclaimer, the term of this patent is extended or adjusted under 35 U.S.C. 154(b) by 119 days.

(21) Appl. No.: 11/524,677

(22) Filed: Sep. 21, 2006

(65) Prior Publication Data

US 2008/0074860 A1 Mar. 27, 2008

(51) Int. Cl.
*F21S 8/08* (2006.01)

(52) U.S. Cl. ..... 362/374; 362/410; 362/414

(58) Field of Classification Search ..... 362/249, 362/252, 410, 413, 414, 310, 374, 375
See application file for complete search history.

(56) References Cited

U.S. PATENT DOCUMENTS

| | | | | |
|---|---|---|---|---|
| 1,721,176 | A * | 7/1929 | Campo | 362/411 |
| 1,863,607 | A | 6/1932 | Sabath | |
| 2,202,357 | A | 5/1940 | Soriano | |
| 2,945,948 | A | 7/1960 | Maffei | |
| 3,025,392 | A | 3/1962 | Worth | |
| 4,626,972 | A | 12/1986 | Wolf | |
| 5,019,753 | A | 5/1991 | Strauss | |
| 5,067,060 | A | 11/1991 | Sieracki | |
| 5,121,313 | A | 6/1992 | Chang | |
| D356,387 | S | 3/1995 | Schwartz | |
| 5,642,930 | A | 7/1997 | Brown, Sr. | |
| 5,782,554 | A | 7/1998 | Huang | |
| 5,806,973 | A | 9/1998 | Porter | |
| 6,135,622 | A | 10/2000 | Downing | |
| 6,227,680 | B1 * | 5/2001 | Arndt | 362/248 |
| 6,322,228 | B1 | 11/2001 | Feldman | |
| 6,616,298 | B1 | 9/2003 | Bernhard | |
| 6,916,108 | B2 * | 7/2005 | Swanson | 362/410 |
| 7,033,049 | B2 * | 4/2006 | Lin | 362/412 |
| 2003/0007360 | A1 | 1/2003 | Hsieh | |
| 2004/0095781 | A1 | 5/2004 | Lo | |

* cited by examiner

*Primary Examiner*—Thomas M Sember
(74) *Attorney, Agent, or Firm*—Billy A. Robbins

(57) ABSTRACT

A lamp having a body which defines a hollow chamber and is constructed at least in part from translucent material has one or more night lights directed upwardly and supported therein. The body includes a top crown which is held in place by a lock ring secured upon threads of a coupling device. Access to the upwardly directed night lights is obtained by removing the lock ring and moving the top crown upwardly to provide access to the hollow chamber so that one may insert his or her hand into the hollow chamber to remove and replace the lamp. The top crown is then replaced and the lock ring again secured.

6 Claims, 4 Drawing Sheets

LAMP HAVING ONE OR MORE LOW LIGHT LEVEL REPLACEABLE BULBS

FIELD OF THE INVENTION

This invention relates generally to lamps and more particularly to a lamp which includes a general-area lighting means and, in addition, includes a low light level lighting means and is directed specifically to a structure permitting easy replacement of the low light level lighting means.

BACKGROUND OF THE INVENTION

Floor lamps, desk lamps and table lamps are all very well known in the lighting industry. Many of such lamps contain multi-position switches for changing the level of illumination provided by the general area lighting means incorporated within such lamps. Low light level lamps, commonly referred to as night lights, are also well known in the lighting industry and are constructed having many different configurations. It is also known in the prior art to incorporate a low light level light bulb into a table lamp, floor lamp or desk lamp. In many instances, the incorporation of the low light level light bulb accomplishes the additional function of providing a more decorative appearance to the body of the lamp. The present invention is specifically directed to a lamp, which can be a desk lamp, table lamp or floor lamp, of the type which also incorporates as an integral part thereof one or more low light level bulbs housed within the body of the lamp to provide decoration as well as a night light function. In such prior art structures, it is extremely difficult to replace the low light level light bulb when it has burned out. Prior art lamps of this type generally require extensive dismantling of the lamp to gain access to the interior of the lamp to replace the low light level light bulb. In one such prior art lamp the base had to be removed to replace the bulb. One lamp which solves the foregoing problems is shown in U.S. Pat. No. 6,916,108 by the same inventor and assigned to the same assignee as this application and the present invention is an improvement thereon.

Therefore, there is need in the lighting industry for a lamp which incorporates both a general area lighting means and low light level light bulbs (night light) which also provides a means for ready access to the interior of the body so that the night lights may be easily changed when such is required.

SUMMARY OF THE INVENTION

A lamp having a low light level bulb housed within a hollow chamber which includes an enclosure defining the hollow chamber and means for supporting the bulb within the chamber. At least a portion of the enclosure is formed of translucent material and the lamp is adapted for providing ready access to the low light level bulb to change the bulb.

DETAILED DESCRIPTION

A lamp constructed in accordance with the principles of the present invention provides general area lighting and at the same time includes low light level illumination means such as one or more night lights which are contained within a hollow chamber defined by the body of the lamp and when illuminated provides both a decorative feature for the lamp and a night light function. This is accomplished by having the body of the lamp constructed from translucent material or alternatively having portions thereof constructed of translucent material. A multi-way switch 22 is incorporated as a part of the lamp's structure so that the general area lamp or the night lights or both may be energized as desired. The low illumination level light bulbs are easily replaceable by removing a locking ring and lifting the top crown portion of the body to expose the hollow chamber and gain access to the bulbs which may then be replaced after which the top crown and the locking ring are reassembled. Therefore, the integrity of the lamp structure is only slightly disturbed to replace a burned out bulb as opposed to having to dismantle the lamp as has been the case in the prior art. The night light portion of the lamp in accordance with the present invention may be utilized on any type of lamp structure such for example as a desk lamp, a table lamp or a floor lamp without departing from the spirit or scope of the present invention.

Figure 1:
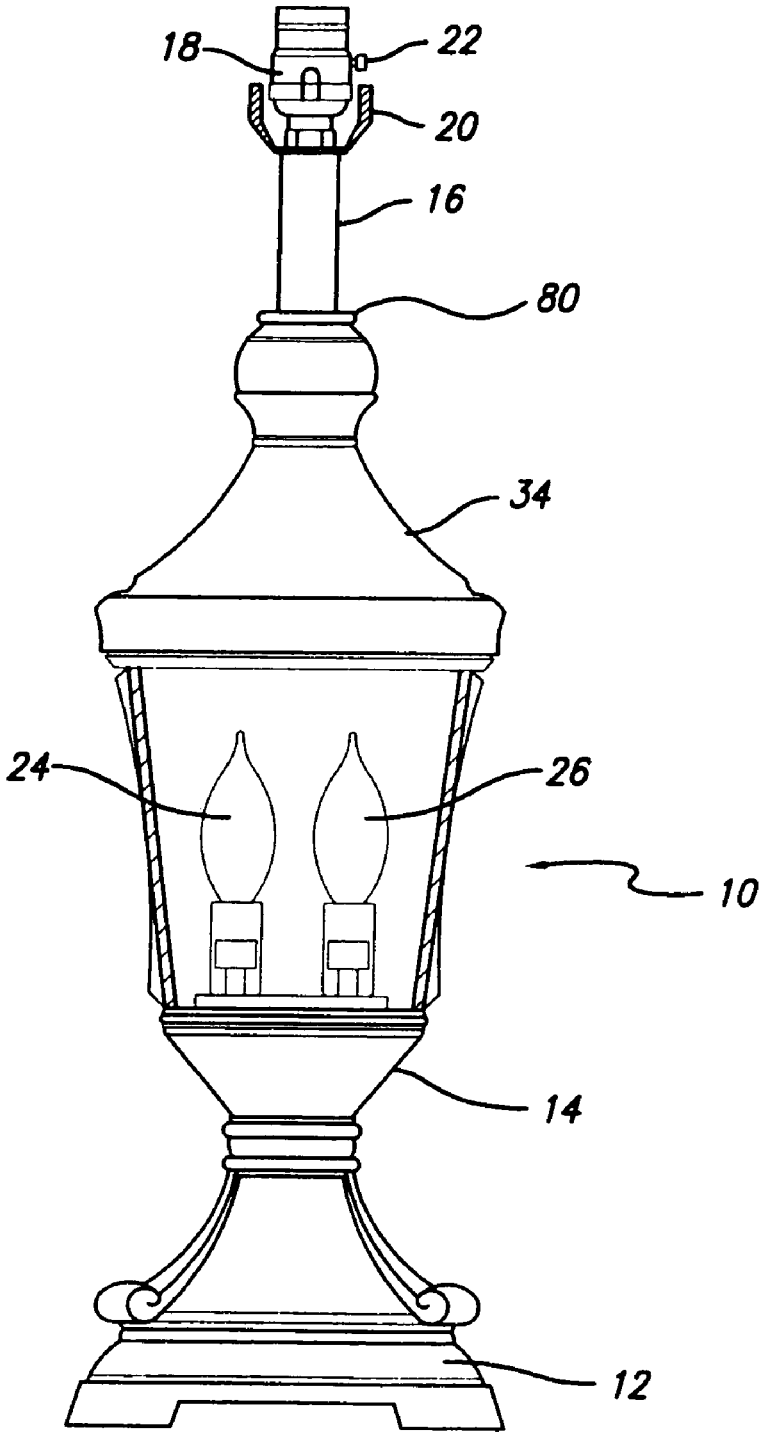
FIG. 1 is a plan view of a table or desk lamp constructed in accordance with the principles of the present invention.

One form of a lamp constructed in accordance with the principles of the present invention is illustrated in FIG. 1 to which reference is hereby made. As is therein shown a table lamp 10 includes a pedestal 12 which supports a body 14 defining a hollow chamber. Extending upwardly from the body 14 is a tubular member 16 which supports a light socket 18 for receiving a typical light bulb (not shown) for use as a general area lighting means. A multi-way switch 22 is provided to allow energization of the general area lighting means or the night light or both. A saddle 20 is affixed to the member 16 and receives the typical wire lampshade support (not shown). A pair of low illumination light bulbs (night lights) 24 and 26 are disposed internally of the body 14 as indicated by the dashed lines. The body 14 is constructed of translucent material such as plastic, glass, fabric or the like depending upon the particular design criteria and decorative environment in which the lamp is to be utilized. In accordance with a preferred embodiment of the present invention the body 14 is constructed of translucent plastic material. It should be expressly understood that the pedestal 12 may be eliminated and the stem of a floor lamp substituted for it with the pedestal then being the terminus of the floor lamp and upon which the floor lamp is supported during use.

Figure 2:
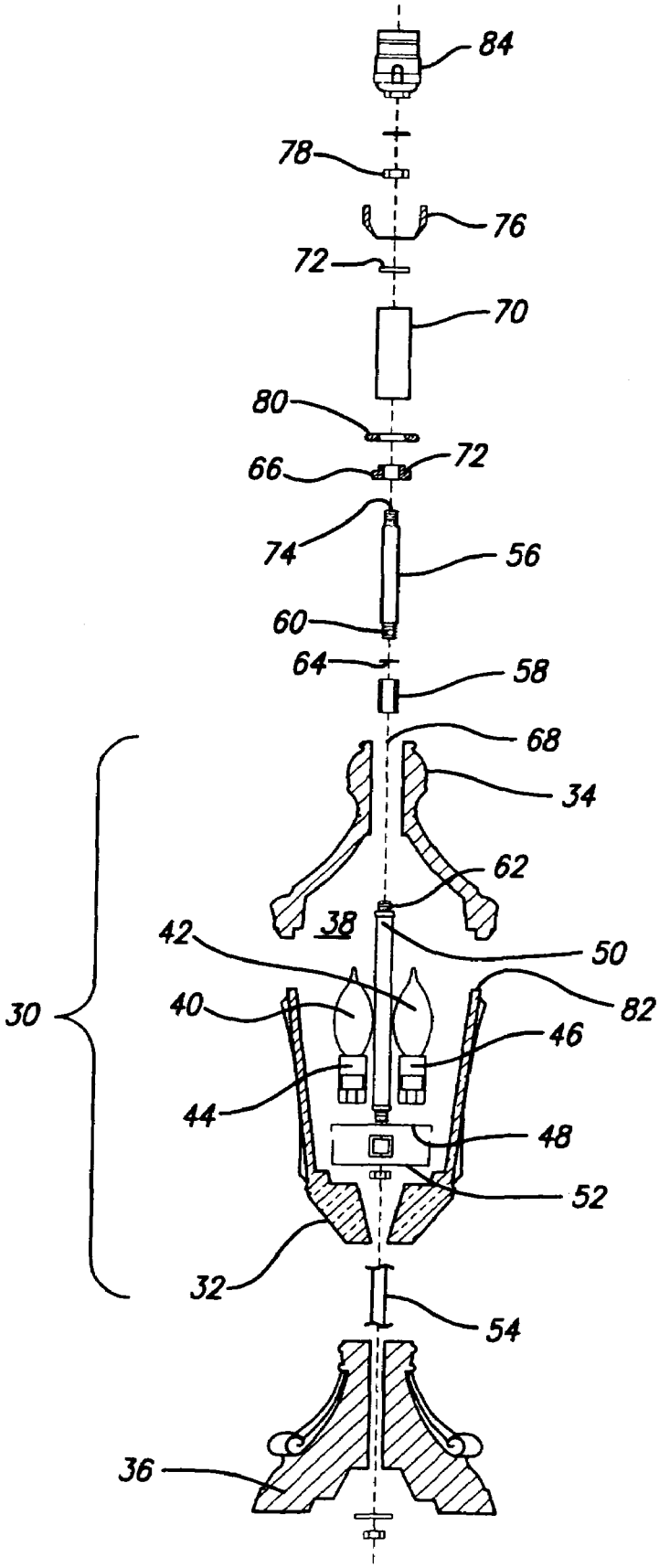
FIG. 2 is an exploded view partially in cross-section of a lamp constructed in accordance with the principles of the present invention.

Referring now more particularly to FIG. 2 there is shown in exploded form the components of a lamp constructed in accordance with the present invention. As is therein shown, the body 30 of a lamp includes a middle crown 32 and a top crown 34 which are positioned upon a base 36. The body defines a hollow chamber or interior closure 38 within which there is disposed a pair of low light level (night light) lamps 40 and 42. The lamps 40 and 42 are received within appropriate electronical sockets 44 and 46 which are mounted upon an outwardly extending platform 48 which is supported upon a center pipe 50 which is secured to the platform 48. Disposed below the platform 48 is a base 52 which receives a pipe or conduit 54 through which appropriate electrical wiring passes into the interior of the base 52 to provide appropriate electrical energy to the lamps 40 and 42 and passes on through the center pipe 50 and upwardly to provide electrical energy to the general area lighting means (not shown). Extending upwardly from the top crown 34 is an additional pipe 56 to which a coupling 58 is secured by the threads 60. The coupling 58 is also secured to the threads 62 on the center pipe 50. A washer 64 is disposed above the coupling 58 and supports a coupling 66 having external threads thereon. The coupling 66, when the lamp is fully assembled, is seated immediately adjacent the opening 68 provided in the top crown 34. A metal tube 70 passes over the exterior of the pipe 56 and seats upon the upper surface of the flange 72 extending outwardly from the coupling 66. A seating ring 72 is disposed upon the top 74 of the pipe 56 which passes therethrough and through an opening provided in the saddle 76. A hex nut 78 fits upon the top of the pipe 56 and secures the saddle 76, metal tube 70, and the coupling 66 together as an integral unit. A lock ring 80 is then secured upon the external thread of the coupling 66 to secure the top crown 34 in place upon the upper ridge 82 of the middle crown 32. A light socket 84 is also affixed to the top 74 of the pipe 56 and receives the electrical wiring previously referred to to provide electrical energy to a general area lighting means (not shown) which is received by the socket 84.

It will be observed by those skilled in the art that the night lights 40 and 42 are disposed so that they are directed upwardly within the hollow chamber 38 of the body 30 of the lamp. If the night lights 40, 42 burn out and need to be replaced such is easily and readily accomplished simply by removing the lock ring 80 from the external threads of the coupling 66 and moving the top crown 34 upwardly which opens up the hollow chamber 38 of the body 30 so that the user may insert his or her hand into the hollow interior 38 remove the bulb(s) 40 or 42 and replace them. After such is done, the top crown is then replaced on the upper edge 82 of the middle crown and the lock ring is again secured to the external threads on the coupling 66 to secure the top crown in place.

Figure 3:
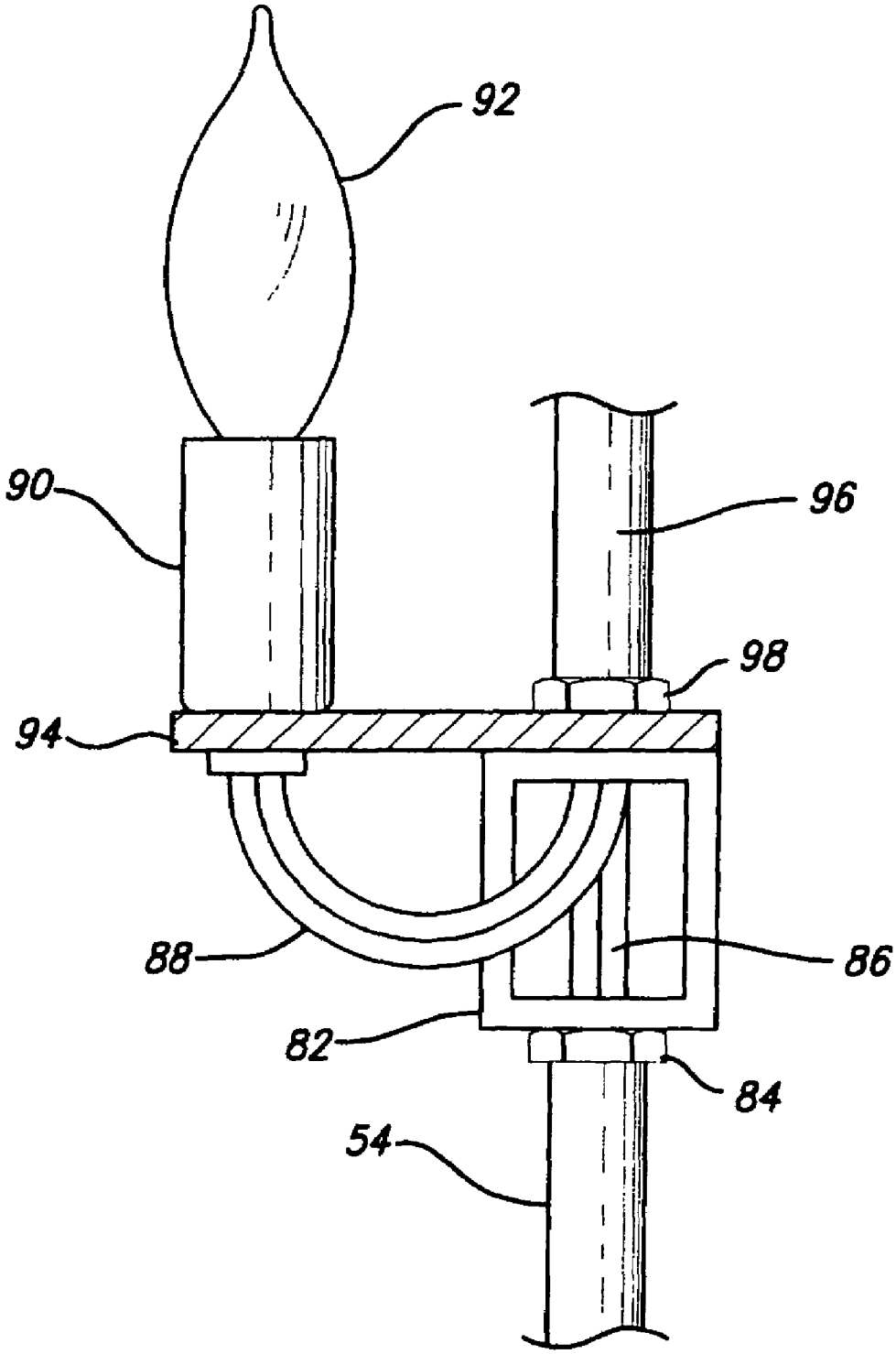
FIG. 3 is a partial view illustrating construction of a lamp having a single night light therein.

It is sometimes desired to have only one night light disposed within the body 30 of the lamp and when such is desired, a structure such as that shown in FIG. 3 may be utilized. As is shown, the pipe 54 engages a hickey 82 which is secured thereto by a hex nut 84 to allow the wiring as shown at 86/88 to pass therethrough and allow connection thereof to the socket 90 which receives the night light 92. It is noted that the socket 90 is mounted upon a bracket 94 which extends laterally outwardly from the pipe 96 which extends upwardly from the hickey 82 and is secured thereto by an appropriate nut 98. Access to the night light 92 is provided in exactly the same manner as above described. That is the lock ring 80 is removed from the external threads of the coupling 66 allowing the top crown 34 to be moved upwardly allowing access to the hollow chamber 38 of the body 30. The night light 92 being directed upwardly as illustrated in FIG. 3 can then be removed and a new one put in place and the top crown repositioned and secured by reattaching the lock ring to the external threads on the coupling 66.

Figure 4:
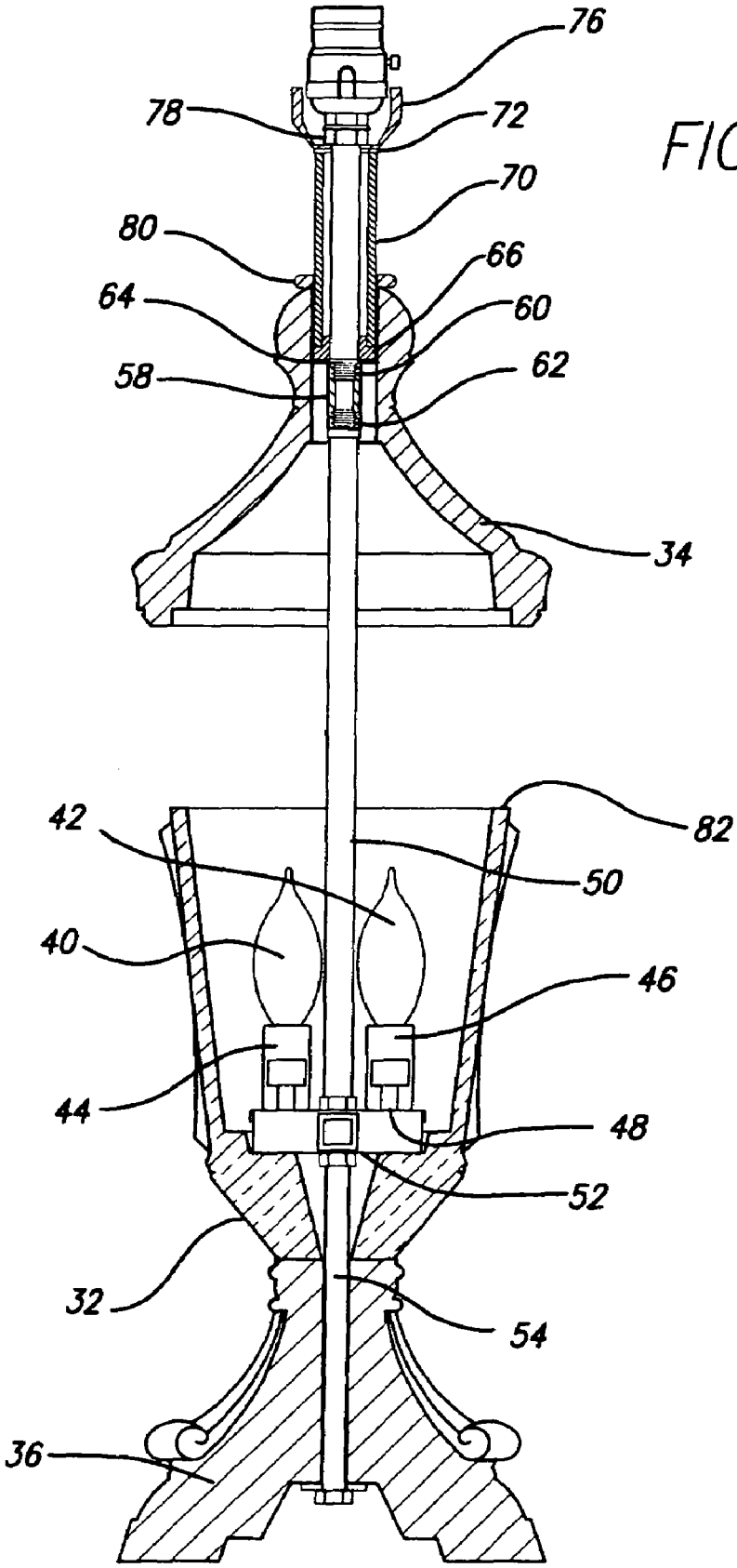
FIG. 4 is a fragmentary view illustrating the manner in which access to the interior of the lamp of the present invention is obtained.

The manner in which access is gained to the hollow chamber 38 of the body of the lamp is illustrated in greater detail in FIG. 4. As is therein shown, the lock ring 80 has been removed from the external threads 100 on the coupling 66 and the top crown 34 has been moved upwardly along the metal tube 70 permitting access to the hollow chamber 38 of the body of the lamp. The burned out bulb 40 or 42 as the case may be may then be removed and replaced with a new bulb after which the top crown 34 is again received on the middle crown 32 and the lock ring 80 re-engaged with the external threads 100 on the coupling 66 to secure the top crown in place.

What is claimed is:

1. A lamp having at least one low light level bulb housed within a hollow chamber comprising:

a. means defining an enclosed hollow chamber having an open upper end and a closed lower end;

b. a removable cap having a central opening therein disposed over but not secured to the upper end of said enclosed hollow chamber;

c. a tubular member extending through said opening in said cap, said tubular member defining external threads adjacent and above said cap;

d. means for supporting said at least one low light level bulb disposed within said hollow chamber adjacent said closed lower end with said at least one bulb facing said open upper end comprising a platform supported by said tubular member with said at least one bulb being supported thereon; and e. a threaded ring threadably received on said threads on said tubular member to secure said cap in place, whereby when said ring is threadably removed from said threads said cap may be moved away from said upper end of said enclosed hollow chamber for allowing a user to reach into said hollow chamber to replace said bulb.

2. A lamp as defined in claim 1 wherein said platform includes a radially outwardly extending platform supported by said tubular member and which further includes a plurality of low level light bulbs supported by said platform.

3. A lamp as defined in claim 2, wherein said platform is the upper surface of an enclosure within which wiring for said plurality of bulbs is housed.

4. A lamp as defined in claim 3, wherein said enclosure is seated upon the closed lower end of said hollow chamber.

5. A lamp having at least one low light level bulb housed within a hollow chamber comprising:

a. means defining an enclosed hollow chamber having an open upper end and a closed lower end;

b. a removable cap having a central opening therein disposed over but not secured to the upper end of said enclosed hollow chamber;

c. a tubular member extending through said opening in said cap, said tubular member defining external threads adjacent and above said cap; and d. means for supporting said at least one low light level bulb disposed within said hollow chamber adjacent said closed lower end with said at least one bulb facing said open upper end claiming said open upper end comprises a bracket extending laterally outwardly from and supported by said tubular member; and e. a threaded ring threadably received on said threads on said tubular member to secure said cap in place, whereby when said ring is threadably removed from said threads said cap may be moved away from said upper end of said enclosed hollow chamber for allowing a user to reach into said hollow chamber to replace said bulb.

6. A lamp as defined in claim 5, which further includes a single low level light bulb affixed to said bracket.

* * * * *